US005307280A

United States Patent [19]

Haug

[11] Patent Number: 5,307,280

[45] Date of Patent: Apr. 26, 1994

[54] FRANKING MACHINE

[75] Inventor: Werner Haug, Langnau, Switzerland

[73] Assignee: Frama AG, Lauperswil, Switzerland

[21] Appl. No.: 754,030

[22] Filed: Sep. 3, 1991

[51] Int. Cl.[5] ..... G07B 17/04

[52] U.S. Cl. ..... 364/464.02

[58] Field of Search ..... 364/464.02

[56] References Cited

U.S. PATENT DOCUMENTS 4,481,604 11/1984 Gilham et al. ..... 364/464.02
4,520,725 6/1985 Haug ..... 101/91
4,759,648 7/1988 Kobayashi et al. ..... 400/568
4,788,623 11/1988 Haug ..... 361/171
5,075,852 12/1991 Salazar et al. ..... 364/464.02

*Primary Examiner*—Edward R. Cosimano
*Attorney, Agent, or Firm*—Ladas & Parry

[57] ABSTRACT

A franking machine comprises, in addition to a main memory, a backup memory which receives the content of the main memory upon opening the casing or a casing cover of the franking machine. After closing the casing or casing cover, the memory contents are returned to the main memory from the backup memory. The interchange of memory contents is initiated by a signal from an electric switch located on the casing. The backup memory ensures that it is not possible to falsity the value amount settlement with the Post Office as a result of servicing or tampering.

3 Claims, 3 Drawing Sheets

FRANKING MACHINE

BACKGROUND OF THE INVENTION

1. Field of the Invention

This invention relates to a franking machine having electromechanic servodrives enclosed in a casing for setting the franking value of typewheels mounted on the printing head, electronic value adders for adding the value of each franking operation to a sum amount of preceding franking operations contained in a main memory, and a central processing unit (CPU).

2. Brief Description of the Prior Art

Known franking machines of this type suffer from the disadvantage that in the case of repairs, when the franking machine casing must be opened or removed, unauthorized changes, or changes not corresponding to the consumption of franking values, can be made to the main memory content. It would be advantageous to provide a franking machine which avoids this disadvantage, so that during maintenance work, operation of the servodrives and changes to the value amount content of the main memory does not lead to permanent changes to the value amount content of the main memory which would otherwise falsify the settlement of accounts with the post office.

SUMMARY OF THE INVENTION

This problem is solved by a backup memory for temporarily storing the contents of the main memory as a result of receiving an "open" signal from signal means located on the casing, and the return of the stored contents back to the main memory upon receiving a "close" signal from such signal means. The signal means can comprise a simple electrical ON-OFF switch which is located on part of the casing and which must be moved from the ON to the OFF condition, or vice versa, when opening and closing the casing.

Thus, as a result, upon opening the franking machine casing the contents of the value amount memory required for the settlement of account with the Post Office remains filed in an otherwise inaccessible backup memory until the casing is closed again.

The invention is described in greater detail hereinafter relative to the drawings, which show:

DETAILED DESCRIPTION OF THE PREFERRED EMBODIMENT

The franking machine, including its electromechanical drives, can e.g., be constructed in accordance with U.S. Pat. No. 4,520,725, incorporated herein by reference, so that there is no need to describe these in detail here.

Figure 1:
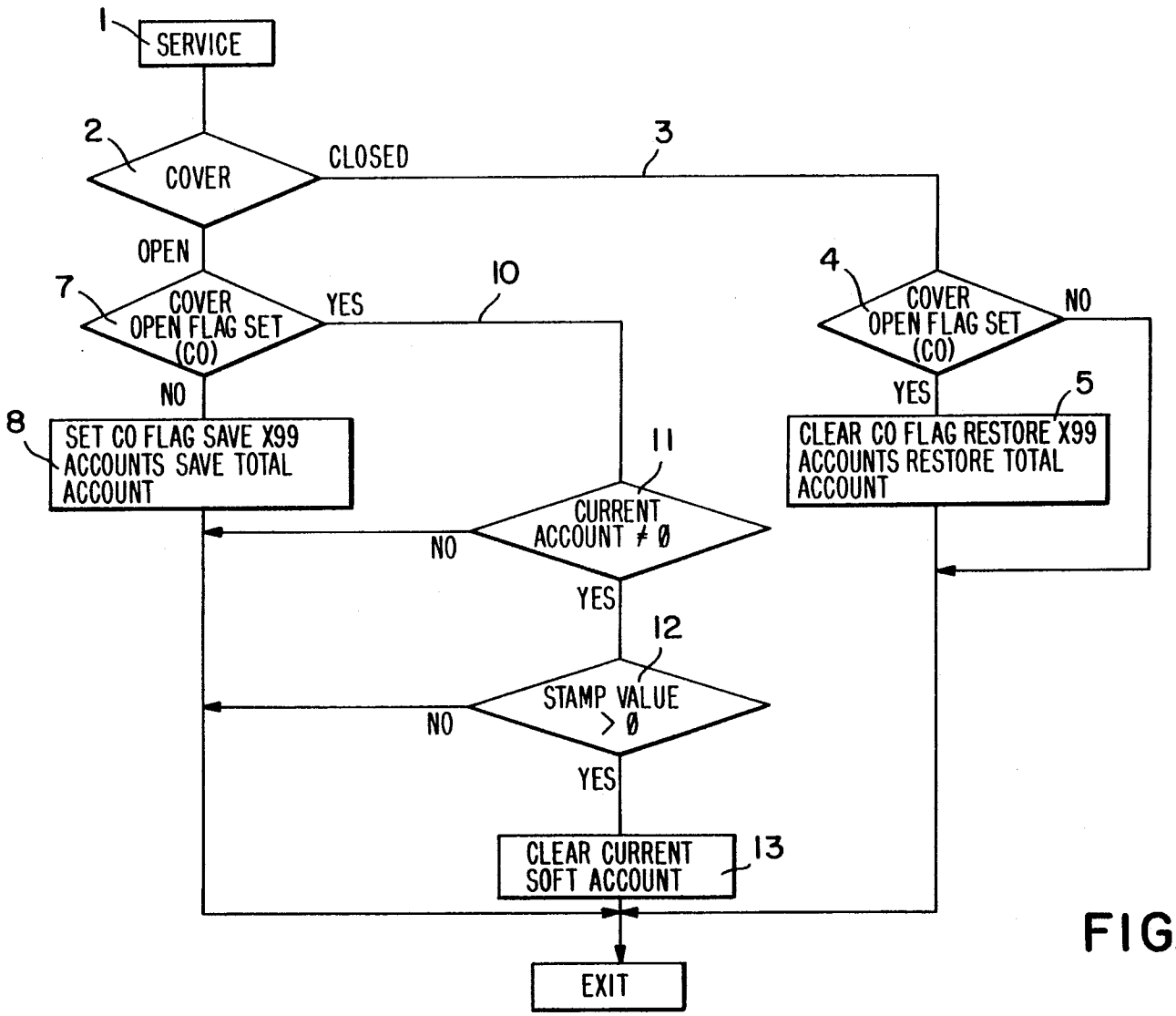
FIG. 1 is a flow diagram of the program of the central processing unit upon opening and closing the casing.
Figure 2:
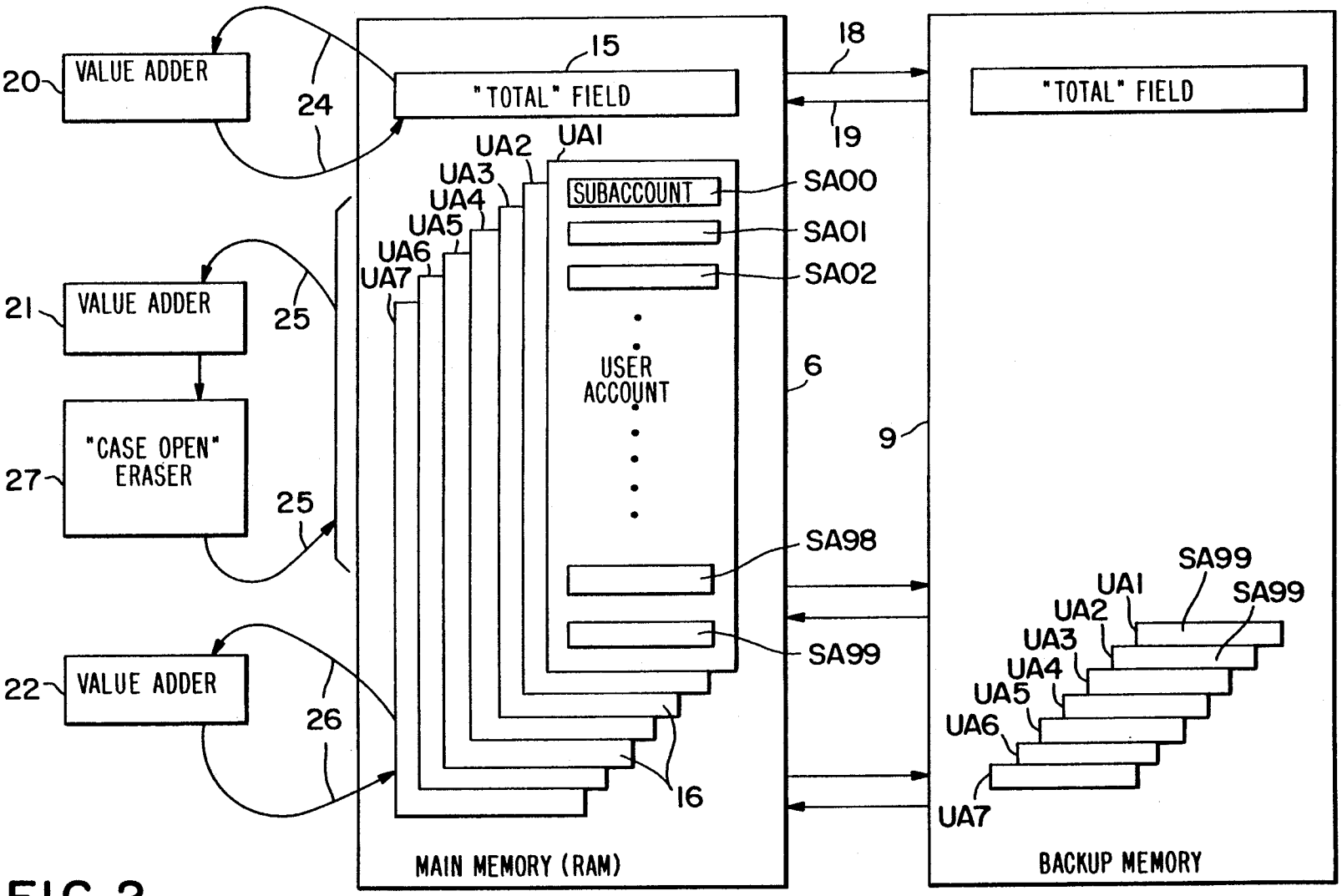
FIG. 2 is a diagrammatic representation of the essential parts of the invention associated with the functional diagram of FIG. 1.
Figure 3:
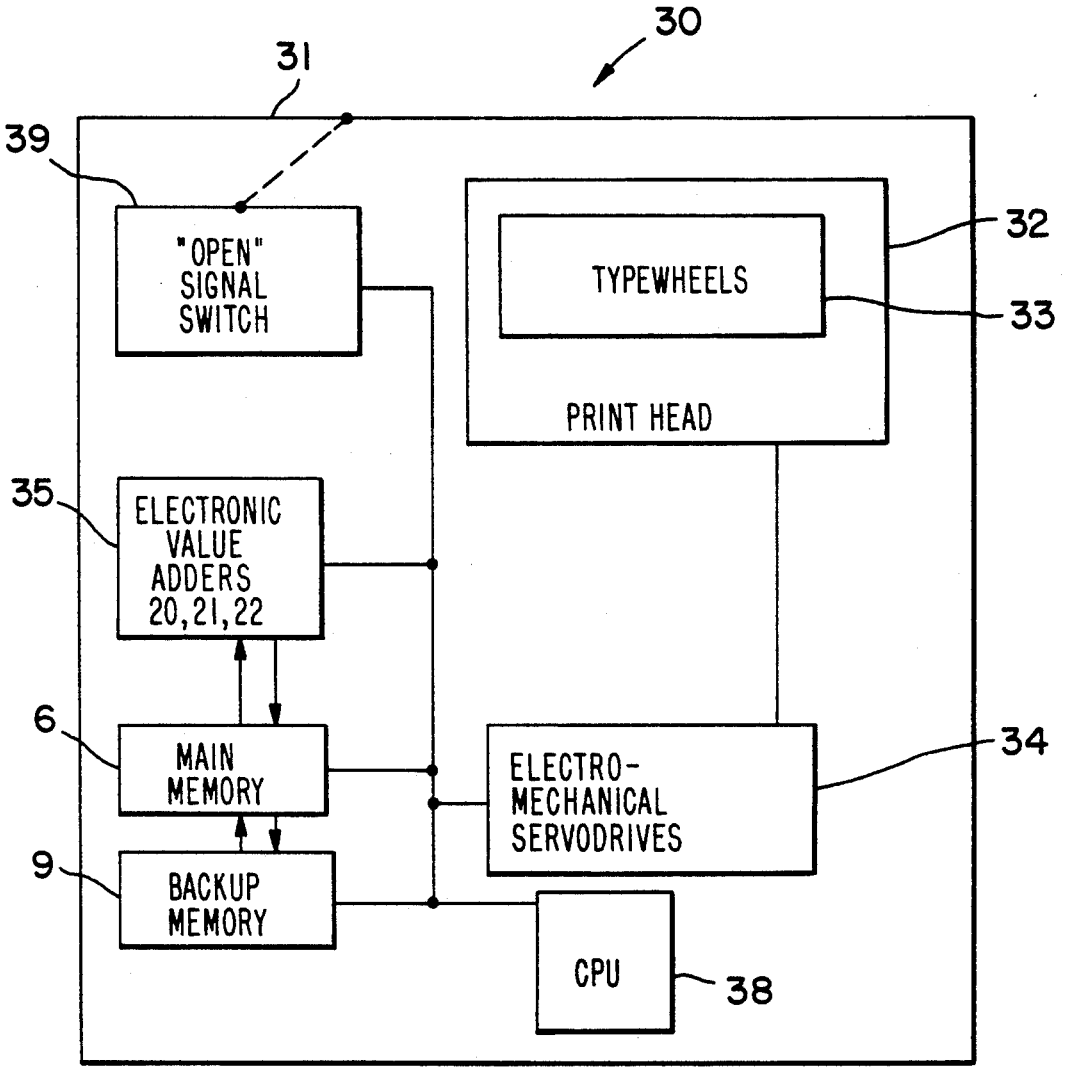
FIG. 3 is a general schematic diagram of the functional blocks of a franking machine employing the present invention.

The function of the franking machine on the basis of its heretofore unknown construction can be gathered from FIGS. 1, 2, and 3.

As noted above, this invention relates to a franking machine 30 having electromagnetic servodrives 34 enclosed in a casing 31 for setting the franking value of typewheels 33 mounted on the printing head 32, electronic value adders 35 for adding the value of each franking operation to a sum amount of preceding franking operations contained in a main memory 6, and a central processing unit (CPU) 38.

According to the program diagram of FIG. 1, it is assumed that the franking machine needs servicing, indicated by function field 1. An interrogation then takes place on the branch field 2 responsive to a signal generator, such as a switch 39 (see FIG. 3), fitted to the franking machine casing indicating whether the latter is open or closed. If the casing is closed, a check is made in accordance with the program line 3 on the branch field 4 as to whether a flag (casing open) has been placed in the program. If this is the case (i.e., the state of function field 4 is yes), then the casing open (CO) flag is reset in function field 5, and the memory contents in the main memory 6 are filled to the state prior to opening the casing by interrogation of the backup memory 9, because the casing is in fact closed.

With the casing open, and in accordance with branch 7, interrogation takes place to establish whether the CO flag (casing open) has been set. If this is not already correct, the CO flag is set in accordance with the function field 8, and also the memory contents of the main memory 6 are saved, i.e. stored in the backup memory 9. If the CO flag has already been set, then in accordance with the program line 10, a check is made on branches 11 and 12, respectively, to establish whether the memory content of the main memory 6 is not equal to zero and whether the setting on the franking head is greater than zero. If the memory content in the main memory 6 is not zero and the set value on the franking head is greater than zero, then they are set to zero in accordance with function field 13. As stated, the corresponding values are in this case stored in the backup memory 9.

FIG. 2 shows, in the central region thereof, the contents of the subdivisions of the non-volatile RAM main memory 6, i.e. the total amount of all the franking operations, represented in field 15, and the different user accounts 16, identified in FIG. 2 as USER ACCOUNTS UA1–UA7, represented in tabular form each of which is subdivided into 100 different subaccounts SA00–SA99. These accounts can be charged as required by the franking machine user upon franking. The allocation to one of the different user accounts takes place by means of an identification code, e.g. according to U.S. Pat. No. 4,788,623. The subdivision into subaccounts has many accounting advantages. Thus, when storing the contents of the main memory 6, it is necessary to carry out storage in the backup memory 9 in accordance with the same subdivision. The arrows 18, 19 "cover open" and "cover closed", respectively, illustrate the interchange of memory contents between the two memories 6 and 9 in accordance with the program diagram of FIG. 1. The value adders 20, 21, 22, necessary for the different memory contents are diagrammatically shown in the left-hand part of FIG. 2. For each addition, the preceding value of the account content is called from the memory 6 and then the amount used for franking is added thereto and is subsequently stored again. This is indicated by the function loops 24, 25, 26. The function field 27 in function loop 25 also indicates that the addition result is erased when the casing is open.

By "EXIT" in FIG. 1 is meant that the procedure according to the present invention is completed, and the result of the procedure is available for whatever use a system designer wishes. Similarly, the beginning of the procedure (at "SERVICE" block 1 in FIG. 1 is under control of the system in which the invention is used. For example, the program routine performed by the claimed invention may start and end under control of a multitasking operating system. The "SERVICE" task which is used for carrying out the program routine of FIG. 1 is initiated periodically, e.g., very 20 ms which is a typical polling interval, provided that it is not momentarily prohibited by another task of higher priority or importance in the operating of the franking machine. Further, several program routines similar to that of FIG. 1 may be connected to and periodically polled by a task monitor in the multitasking operating system. Thus, the program of FIG. 1 proceeds, after function blocks 5, 8, and 13 (and after function blocks 4, 11, and 12 if the inquiry in each block is "NO") in accordance with the demands of the franking machine system in which the program of FIG. 1 is employed.

I claim:

1. Apparatus for use in a franking machine of the type having electromechanical servodrives enclosed in a casing for setting the franking value of typewheels mounted on a printing head, electronic value adders for adding in a main memory means the value of each franking operation to a sum amount of the preceding franking operation, and a central processing unit, said apparatus comprising:

signal means for producing an "open" signal when said casing is open and a "closed" signal when said casing is closed;

backup memory means for temporarily receiving the contents of said main memory means as a result of said "open" signal and for returning the contents of said backup memory means to said main memory means responsive to said "closed" signal from said signal means.

2. The apparatus according to claim 1, wherein the contents of the main memory is subdivided in accordance with different user accounts, and the interchange of the memory contents between said main memory means and said backup memory means takes place in accordance with such subdivision.

3. The apparatus according to claim 2, wherein the user accounts are further subdivided into subaccounts, and the interchange of memory contents between said main memory means and said backup memory means takes place in accordance with such further subdivision.

* * * * *